United States Patent [19]

Sato

[11] 4,253,395

[45] Mar. 3, 1981

[54] CONSTANT PRESSURE PRINTING MECHANISM FOR HAND LABELER

[75] Inventor: Yo Sato, Tokyo, Japan

[73] Assignee: Kabushiki Kaisha Sato Kenkyusho, Tokyo, Japan

[21] Appl. No.: 44,768

[22] Filed: Jun. 1, 1979

[51] Int. Cl.[3] ..... B65C 11/02

[52] U.S. Cl. ..... 101/292; 101/288; 101/316; 156/384; 156/DIG. 49

[58] Field of Search ..... 156/384, 577, DIG. 49; 101/287, 288, 291, 292, 316

[56] References Cited

U.S. PATENT DOCUMENTS

| | | | |
|---|---|---|---|
| 4,057,452 | 11/1977 | Sato | 156/384 |
| 4,072,105 | 2/1978 | Becker et al. | 156/384 |
| 4,113,544 | 9/1978 | Sato | 156/384 |
| 4,179,989 | 12/1979 | Sato | 101/288 |
| 4,187,778 | 2/1980 | Holland-Letz | 156/384 |

*Primary Examiner*—Michael G. Wityshyn

*Attorney, Agent, or Firm*—Ostrolenk, Faber, Gerb & Soffen

[57] ABSTRACT

The disclosure concerns a constant pressure printing mechanism for use with a hand labeler. A continuous strip of labels is fed in increments by manual squeezing of a hand lever. The constant pressure printing mechanism includes a retaining member hinged to the frame of the hand labeler and biased by a spring into abutment contact with an actuating member, which is hinged to the hand lever. The actuating member is also biased by a tension spring to shift out of engagement with the retaining member until the actuating member is halted by a stopper. A release member is mounted on the hand lever for releasing the retaining member from engagement with the actuating member when the hand lever is squeezed toward the grip. Thus, printing is effected under a constant pressure that is determined by the inertia of the hand lever caused by the release of said actuating member irrespective of the intensity of the squeezing force of the hand lever.

9 Claims, 4 Drawing Figures

CONSTANT PRESSURE PRINTING MECHANISM FOR HAND LABELER

BACKGROUND OF THE INVENTION

1. Field of the Invention

The present invention relates to a label printing and applying machine also referred to herein as a hand labeler, and more particularly relates to a constant pressure printing mechanism for use with the hand labeler.

2. Description of the Prior Art

Known constant pressure printing mechanisms have complicated mechanisms and use many parts so that their assembly is accordingly complicated. Moreover, operation of the labeler frequently has problems, and adjustment to the constant pressure requires high skills. Examples of somewhat complicated but still effective constant pressure printing mechanisms can be found in my U.S. Pat. No. 4,149,462, issued Apr. 17, 1979 and my U.S. Pat. No. 4,113,544, issued Sept. 12, 1978.

In a hand labeler without a constant pressure printing mechanism, the density of the prints on the labels is directly dependent upon the intensity of the squeezing force applied to the hand lever of the hand labeler. If the squeezing force is too strong, the imprints are excessively dense, and if the squeezing force is too weak, the prints become excessively thin. Thus irregular quality printing occurs. Recently, regular printing has become more important because the so-called "POS (Point-of-Sales) System" has been put into practice. Highly accurate label imprints are required because the POS System resorts to optical scanner reading of the information printed on labels.

Moreover, in the POS System using bar codes, the printing area required is quite wide so that the printing pressure required is accordngly quite high.

SUMMARY OF THE INVENTION

It is therefore an object of the present invention to provide a constant pressure printing mechanism for use with a hand labeler, which mechanism is free from the drawbacks experienced with the prior art.

Another object of the present invention is to provide a constant pressure printing mechanism of the above type, for construction of which fewer parts are required and which can be operated with less troubles than prior art constant pressure printing mechanisms.

A further object of the present invention is to provide a constant pressure printing mechanism, which enables establishment of a sufficiently high printing pressure to ensure the desired clear imprints without resorting to any adjustment of the constant pressure.

The present invention provides a constant pressure printing mechanism for use with a hand labeler. The labeler includes a grip lever that is part of the frame of the labeler. A hand lever is hinged to the labeler frame and is adapted to be manually squeezed toward the grip lever. A return spring mounted between the hand lever and the grip lever biases them apart. A printing head carried on the leading end of the hand lever carries a type bearing surface. A printing platen is mounted to the labeler frame and is positioned to face the type bearing surface of the printing head. When the hand lever is squeezed toward the grip lever against the biasing force of the return spring, the printing head is moved into abutment contact with a continuous strip of labels which are fed onto the printing platen so that the label strip may be imprinted with the indicia on the type bearing surface.

The constant pressure printing mechanism for this hand labeler comprises a retaining member hinged to the grip lever and comprises an actuating member hinged to the hand lever. First bias means bias the retaining member into abutment engagement with the actuating member. Second bias means bias the actuating member out of engagement with the retaining member. A release member mounted on the hand lever releases the retaining member from engagement with the actuating member when the hand lever is squeezed toward the grip lever. As a result, the printing operation is effected under a constant pressure that is determined by the inertia of the hand lever caused by the release of the actuating member, irrespective of the intensity of the squeezing of the hand lever.

BRIEF DESCRIPTION OF THE DRAWINGS

Other objects and features of the present invention will become apparent from the following description taken in conjunction with the accompanying drawings, in which.

DESCRIPTION OF THE PREFERRED EMBODIMENT

One embodiment of the present invention is now described with reference to the accompanying drawings.

Figure 2:
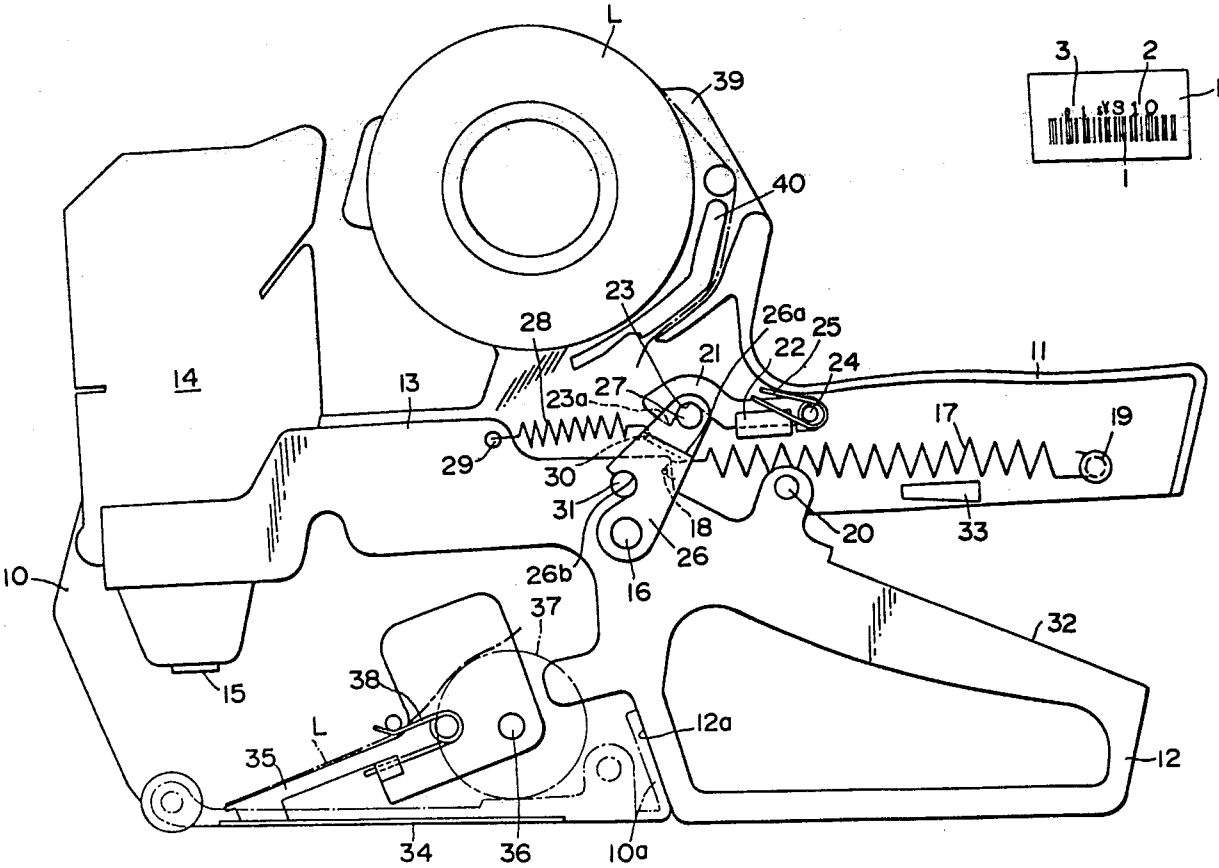
FIG. 2 is a side elevational view showing the hand labeler in a rest condition, and which is equipped with the constant pressure printing mechanism according to the present invention, with the side on the viewing side being removed.

Referring to FIG. 2, parts of a hand labeler containing the invention are illustrated. A pair of juxtaposed, spaced apart frames 10 of a hand labeler extend rearwardly to form a pair of parallel, engaging grip levers 11. A hand lever 12 is spaced from and faces toward the grip levers 11. The hand lever 12 is pivotally attached to the labeler frames 10 by a pivot pin 16 such that the hand lever 12 can be squeezed toward and released apart from the grip levers 11.

Figure 1:
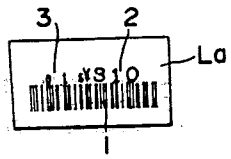
FIG. 1 is a top plan view showing a self-adhesive label which has been imprinted by means of a constant pressure printing mechanism according to the present invention.

The leading end portion of the hand lever 12, which is located in front of the pivot pin 16, is integral with a pair of yokes 13 which carry a printing head 14 between them. The printing head 14 carries a rotationally selectable type bearing surface 15. As can be seen from the imprinted label of FIG. 1, for example, the type bearing surface 15 has a wide printing area which can print a self-adhesive label La with both a price code 2 and a bar code 1 which is used to correspond to a commodity code so that it may be read out by an optical character reader.

A return spring 17 is provided in the grip levers 11. The return spring has one end that is retained in a spring holding hole 18 formed in the hand lever 12 and has its other end retained on a spring holding pin 19 mounted in the grip levers 11, whereby the return spring may return the hand lever 12 and accordingly the printing head 14 to their initial rest positions after the printing operations. With this construction, therefore, the hand lever 12 is biased clockwise at all times by the action of the return spring 17 to move apart from the grip levers 11. The biasing force of the return spring 17 also causes the abutment contact between the pressure receiving surface 10*a* at the rear end of the labeler frames 10 and the pressure applying surface 12*a* formed in front of the hand lever 12, thus establishing the rest position shown in FIG. 2.

There is a release member 20, which is comprised of a roller, or the like, provided on the upper side of the hand lever 12 and at the side of the hand lever trailing the pivot pin 16. On the hand lever 12, to the rear of the release member 20, there is a regulating surface 32 which includes a notch that can be brought into abutment contact with a cooperating stopper 33 formed in the grip levers 11.

Figure 3:
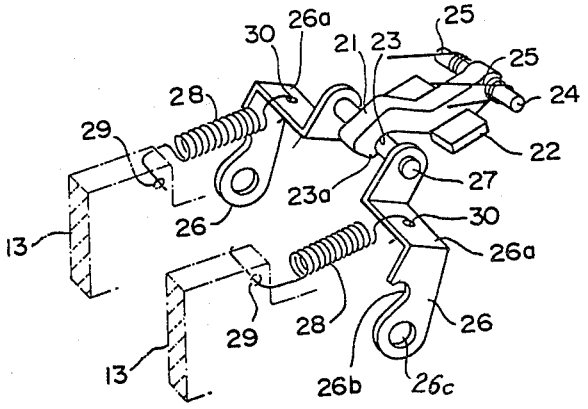
FIG. 3 is an exploded perspective view showing essential parts of the constant pressure printing mechanism of the present invention.

As shown in FIG. 3, a pair of actuating members 26 each having the S-shape of a bent lever, is mounted at the holes 26*c* in the lower portions thereof on the pivot pin 16 of the hand lever 12. The upper portions of the members 26 carry a retainable pin 27 between them. A pair of tension springs 28 are received in the spring holding holes 30 formed in the bent intermediate shoulder portions 26*a* of the actuating members 26 and in the spring holding holes 29 formed in the yokes 13 of the hand lever 12 in front of the pivot pin 16. As a result, the actuating members 26 are biased counter-clockwise by the tension springs 28. On the other hand, the actuating members 26 are pushed to the substantially rightward inclined positions of FIG. 2, by the abutment of the members 26 against the stoppers 31 embedded at both sides of the hand lever. This also regulates the biasing forces of the springs 28.

There is a hook-shaped retaining member 21 which acts together with the actuating members 26 and the release member 20. The retaining member 21 is mounted in the grip levers 11 of the labeler frames 10 at a position to be engaged by the members 26 and 20. The retaining member 21 is mounted to a pivot pin 24, on which a torsion spring 25 is also mounted. The leading end of the retaining member 21 is an engagement surface 23, which is engageable with the retaining pin 27 of the actuating members 26. At both of its sides, the retaining member carries abutment portions 22, which are adapted to be abutted by the release member 20 so as to release the retaining member 21 from engagement with the retaining pin 27. The retaining member 21 is biased counter-clockwise by the biasing forces of the springs 25 so that the engagement surface 23 is brought into abutment contact with the retaining pin 27 of the actuating members 26.

The self-adhesive labels which are printed and then applied to commodities are temporarily adhered in series to a strip of carrier paper, thus forming a part of a continuous strip of labels L, having the labels La arranged continuously or discontinuously in the longitudinal direction thereof. The continuous label strip L is held rolled upon a label roller holder 39, which is arranged above the labeler frames 10. The label strip L is unrolled to pass along a label guide 40. The label strip L thus guided is advanced pitch by pitch (e.g., corresponding to the length of each label La) onto a printing platen 35 by the intermittent rotation of a feed roller 37. By known means, such intermittent rotation of the feed roller occurs each time the hand lever 12 is released after being squeezed. The feed roller 37 is rotatably mounted on its shaft 36 which is fixed between the labeler frames 10.

The printing platen 35 is positioned to face the type bearing surface 15 of the printing device 14. The printing platen 35 has its rear or base portion hinged to the feed roller shaft 36 so that the platen can be turned counter-clockwise for facilitating the initial charging of the continuous label strip L into the labeler. In order that the printing platen 35 may be fixed in position when the bottom cover 34 of the labeler is locked, the printing platen 35 can be fixed in position to the labeler frames 10 by means of a platen positioning member 38 such as a torsion spring. As a result, the printing platen 35 is biased stably on the bottom cover 34 by the biasing force of the positioning member 38. If the printing platen 35 is not of the rotary but of the stationary type, it is fixed to the labeler frames 10 or to the stationary bottom cover.

The operation of constant pressure printing mechanism is now described.

As the hand lever 12 is squeezed from its rest position of FIG. 2, it is turned counter-clockwise and is raised toward the grip levers 11 about the pivot pin 16. The printing head 14 is accordingly moved down toward the printing platen 35. Meanwhile, the inking roller of an ink supply mechanism (not shown) is turned over the type bearing surface of the printing head 14 for inking the printing head type surface 15. As the hand lever is further squeezed, the release member 20 is moved into abutment contact with the abutment portions 22 of the retaining member 21 so that the retaining member 21 is slightly lifted clockwise about the pivot pin 24 against the biasing force of the torsion springs 25.

As a result, the retaining member 21 is raised slightly, but its engagement surface 23 retains its contact with the retainable pin 27 of the actuating members 26 by the biasing force of the torsion springs 25. As the hand lever 12 is squeezed further, the yokes 13 are turned downward about the pivot pin 16, but the actuating members 26 remain in the rest position of FIG. 2 for a while because the retaining member 21 is biased by springs 25 to overcome the turning force being exerted by the actuating members 26. As a result, due to the pivoting of the yokes, a slight clearance is established between the stoppers 31 and the abutment surfaces 26*b* of the actuating members 26.

When the hand lever 12 is squeezed to its full stroke, the engagement surface 23 of the retaining member 21 remains on and slides on the retainable pin 27 until the tension springs 28 which are held under tension between the yokes 13, which have now become inclined at a large angle, and the actuating members 26, acquire sufficient biasing force due to the stretching of springs 28 to overcome the biasing force of the torsion springs 25 of the retaining member 21 at the projecting portion 23*a* or tip of the engagement surface 23.. As a result, the released retainable pin 27 is abruptly turned counter-clockwise by the tensioned tension springs 28.

Figure 4:
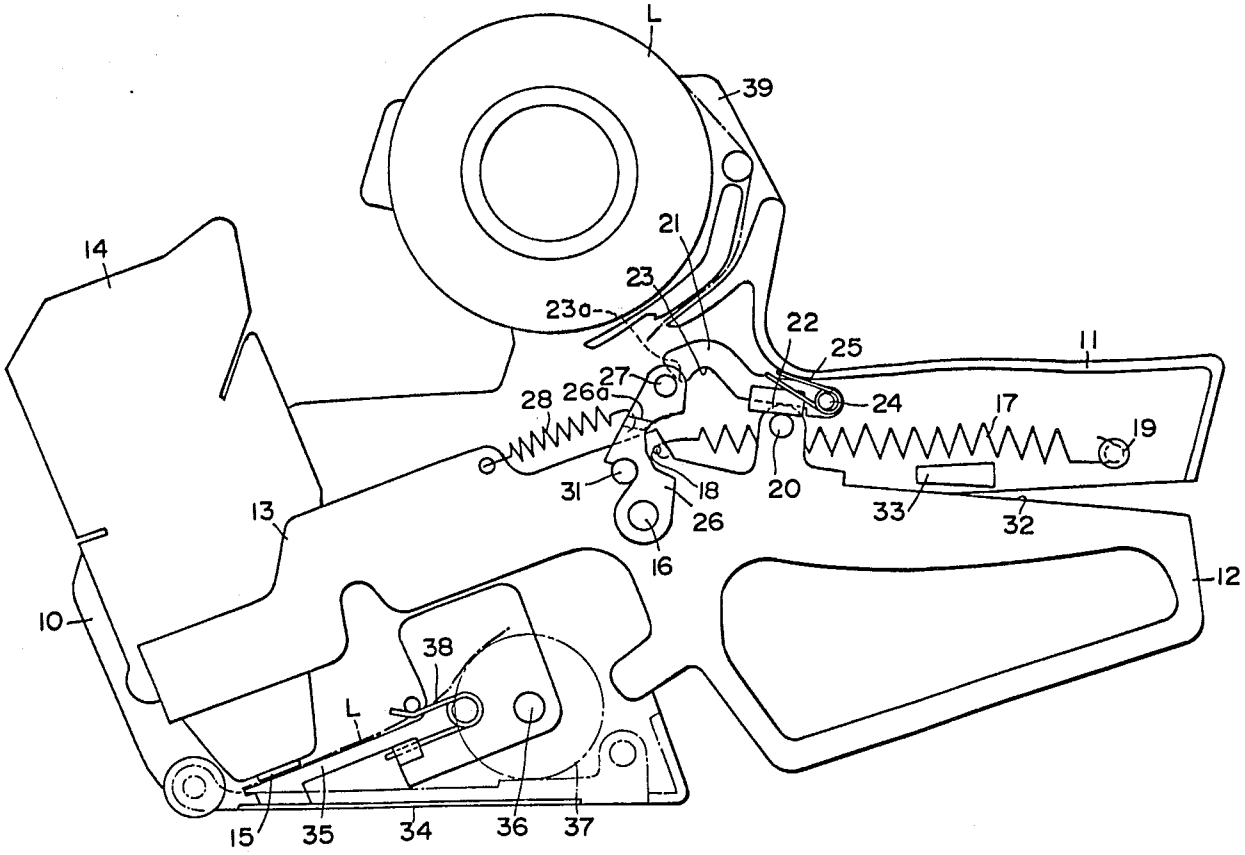
FIG. 4 is similar to FIG. 2, but showing the constant pressure printing mechanism in a printing condition.

Referring to FIG. 4, at this time, the retainable pin 27 overcomes the ride-over resistance of the projecting portion 23*a* of the retaining member 21 and passes it. As a result, the resistance which has been exerted upon the hand lever 12 by the tension springs 28 suddenly disappears so that the continuous label strip L positioned on the printing platen 35 is imprinted under a preset constant printing pressure with the indicia of the type bearing surface 15 of the printing head 14 by the downward inertial motion of the yokes 13 resulting from the squeezing action of the hand lever 12 and the coactions between the actuating members 26 and the tension springs 28.

The return of the constant pressure printing mechanism begins by releasing the squeezed hand lever 12. Then, the printing head 14 and the hand lever 12 are returned to their rest conditions of FIG. 2 by the biasing force of the return spring 17.

As has been described hereinbefore, the constant pressure printing mechanism of the present invention is equipped with both a retaining member, which is elastically biased to the grip levers of the stationary frames of a hand labeler, and the actuating members, which are elastically biased to the movable hand lever such that they are made engageable with the retaining member. As a result, the actuating members are operated by the coaction among the afore-mentioned members so that the desired constant pressure printing operation can be performed.

Moreover, the constant printing pressure is established by bringing the printing head from its upper rest position into abutment contact with the printing platen which is disposed at the lower position of the labeler frames without a halt intermediate its travel path. As a result, the printing pressure is high enough to even print bar codes, or the like imprints having a wide printing area.

Furthermore, the construction of the printing mechanism according to the present invention is simplified in comparison with a full-scale constant pressure printing mechanism, in which, for example, the printing platen is popped slightly up to the lowering printing head. As a result, less troubles take place, and the number of parts required is so reduced that the production cost of the labelers can be minimized while their assembly is facilitated.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A constant pressure printing mechanism for use with a hand labeler, said hand labeler comprising a frame; a grip lever forming a portion of said frame; a hand lever hinged to said frame and adapted to be manually squeezed toward said grip lever, a printing head carried on said hand lever, spaced from the hinged connection between said hand lever and said frame and formed with a type bearing surface; said hand lever supporting said printing head such that said printing head moves rigidly with said hand lever; a printing platen mounted to said labeler frame and positioned to face said type bearing surface of said printing head, whereby when said hand lever is squeezed toward said grip lever, said printing head is brought into abutment contact with a label which is on said printing platen so that the label may be imprinted with the indicia of said type bearing surface;

said constant pressure printing mechanism comprises: a retaining member hinged at a first pivot to said labeler frame; an actuating member hinged at a second pivot to pivot with respect to said hand lever; first bias means for biasing said retaining member into engagement with said actuating member; said retaining member being shaped to prevent said actuating member from moving under bias; second bias means for biasing said actuating member to move out of engagement with said retaining member; and a release member mounted on said hand lever and movable therewith for releasing said retaining member from engagement with said actuating member when said hand lever is squeezed toward said grip lever, whereby the printing operation is effected under a constant pressure caused by said release of said actuating member and the bias of said second bias means irrespective of the intensity of the squeezing force applied to said hand lever.

2. A constant pressure printing mechanism according to claim 1 further comprising a return spring mounted between said hand lever and said grip lever for said hand lever for countering the squeezing force applied to said hand lever and for returning said hand lever from the squeezed condition.

3. A constant pressure printing mechanism according to claim 2, wherein said retaining member is hinged to said grip lever of said labeler frame.

4. A constant pressure printing mechanism according to claim 1, wherein said actuating member is hinged at a common axis of rotation of the hinged connection of said hand lever while being allowed to rotate relative to said hand lever.

5. A constant pressure printing mechanism according to claim 4, further comprising a stopper placed on said hand lever for being engaged by said actuating member and blocking further motion thereof after predetermined motion of said actuating member under the influence of said second bias means.

6. A constant pressure printing mechanism according to either of claims 1 or 4, wherein said actuating member includes a retainable pin extending across the direction of pivoting motion of said retaining member and wherein said retaining member is formed with an engagement surface by which said retainable pin of said actuating member can be engaged.

7. A constant pressure printing mechanism according to either of claims 1 or 4, wherein said first bias means includes a torsion spring mounted on the pivot pin of said retaining member and having its one end held on said frame and its other end held on said retaining member.

8. A constant pressure printing mechanism according to either of claims 1 or 4, wherein said second bias means includes a spring having one end held to said hand lever for being shifted therewith and having its other end held on said actuating member such that movement of said hand lever increases the bias of said second bias means until said retaining member releases said actuating member.

9. A constant pressure printing mechanism according to claim 8, wherein said second bias means spring comprises a tension spring and said one end thereof is held to said hand lever on the side of said hand lever hinged connection which side is toward said type bearing surface so that said actuating member will be biased to pivot toward said type bearing surface.

* * * * *